US006447206B1

(12) United States Patent
Fleury

(10) Patent No.: US 6,447,206 B1
(45) Date of Patent: Sep. 10, 2002

(54) BEAVER CONTROL SCREEN FOR CULVERT PIPE

(75) Inventor: Marc Fleury, Bic (CA)

(73) Assignee: Faune-Experts Inc., Bic (CA)

( * ) Notice: Subject to any disclaimer, the term of this patent is extended or adjusted under 35 U.S.C. 154(b) by 0 days.

(21) Appl. No.: 09/883,879

(22) Filed: Jun. 19, 2001

(51) Int. Cl.[7] ..... E03F 7/06

(52) U.S. Cl. ..... 405/125; 405/124; 210/154; 210/162

(58) Field of Search ..... 405/124, 125; 43/64, 100; 210/162, 154

(56) References Cited

U.S. PATENT DOCUMENTS

| | | | | | |
|---|---|---|---|---|---|
| 891,012 | A | * | 6/1908 | Shepard | 137/527.6 |
| 906,562 | A | * | 12/1908 | Rue et al. | 210/131 |
| 1,371,143 | A | * | 3/1921 | Bradburn | 210/460 |
| 2,970,697 | A | * | 2/1961 | Larson et al. | 210/163 |
| 3,074,555 | A | * | 1/1963 | Rudzinski | 210/161 |
| 3,472,030 | A | * | 10/1969 | Rieke | 405/125 |
| 3,587,239 | A | * | 6/1971 | Feland | 138/96 R |
| 4,538,375 | A | * | 9/1985 | Kelley | 43/60 |
| 4,658,449 | A | * | 4/1987 | Martin | 210/162 |
| 4,713,179 | A | * | 12/1987 | Goedderz, Sr. | 210/155 |
| 4,929,350 | A | * | 5/1990 | Wade et al. | 210/156 |
| 4,998,847 | A | * | 3/1991 | Thurber | 210/164 |
| 5,037,542 | A | * | 8/1991 | Carroll | 137/527.8 |
| 5,090,152 | A | * | 2/1992 | Ling | 137/849 |
| 5,102,537 | A | * | 4/1992 | Jones | 138/96 R |

FOREIGN PATENT DOCUMENTS

| | | | | |
|---|---|---|---|---|
| CA | 1234766 | * | 4/1988 | E02B/5/08 |

* cited by examiner

*Primary Examiner*—Heather Shackelford
*Assistant Examiner*—Katherine Mitchell

(57) ABSTRACT

The beaver control screen has a cone-shaped screen having a base, an apex and a horizontal axis. A first set of spaced-apart rods extends from the base to the apex and are disposed in a first conical layer. A second set of rods is disposed in a second conical layer inside the first conical layer and extends toward the apex over a distance of about one-half the length of the first conical layer. The first and second conical layers are set at different angles with the horizontal axis such that a distance between a rod in the first layer and an adjacent rod in the second layer is a same distance along the adjacent rod. At the apex of the screen, the rods in the first conical layer are alternately affixed to the outside edge and to the inside edge of an annular plate.

20 Claims, 4 Drawing Sheets

ECH. 1"=1'-0"

ECH. 1"=1'-0"

SCH. 1"=1'-0"

ECH. 3"=1'-0"

ECH. 3"=1'-0"

BEAVER CONTROL SCREEN FOR CULVERT PIPE

FIELD OF THE INVENTION

This invention pertains to a cone-shaped screen for attachment to the end of a culvert pipe for preventing beavers from constructing a dam upon the end of, or inside the culvert pipe. More particularly, the present invention pertains to a double layered cone-shaped screen with aperture dimensions selected to refuse access to beavers and to let local fish and floating debris there through.

BACKGROUND OF THE INVENTION

A culvert pipe along a stream represents an ideal flow restriction upon which a beaver can build a dam. In periods of rising water due to heavy rains or melting snow for example, such dams are known to cause road flooding and road undermining which often result in extensive damage. Road maintenance personnel usually try to dismantle a beaver dam at an early stage of its construction. As part of the dismantling process, the beavers are trapped and re-located in deeper forests. This relocation of the animals is a temporary solution because other beavers usually come along and start all over. Therefore it is preferable to install permanent screens over the ends of a culvert pipe in which flows an active brook or stream, to discourage any beaver from attempting to construct a dam at that location.

Certain types of screens or grates mounted over the end of a culvert pipe are known to be efficient devices for discouraging beavers from building a darn. However, such screens or grate must be made so that the flow of water through the culvert pipe, in all seasons, is not adversely affected. Similarly, the circulation of the local fish through the screen must be maintained such that the natural fish habitat is not disturbed. It is believed that these two particular requirements for an efficient beaver control screen represent some challenges and have not been properly addressed in the past.

It is known that several types of beaver control screens and grates have been developed and used in the past with varying degrees of success. Some of these inventions are described herein below.

The first type of culvert pipe screen of the prior art consists of a wire strainer mounted inside the pipe, to prevent rodents from entering the pipe and freely circulating inside the pipe. Culvert pipe screens of this type are described in the following patents:

U.S. Pat. No. 906,562, issued on Dec. 15, :1908 to C. S. Rue et al.;

U.S. Pat. 5,090,152, issued on Feb. 25, 1992 to R. Ling.

A second type of screen consists of a grating mounted over the end of a culvert pipe. The grating has a flat surface and is made of parallel and perpendicular bars affixed to each other and to the pipe. Some of these screens are described in the following patents:

U.S. Pat. No. 3,587,239, issued on Jun. 28, 1971 to O. A. Feland;

U.S. Pat. No. 5,037,542, issued on Aug. 6, 1991 to K. T. Carroll;

U.S. Pat. No. 4,713,179, issued on Dec. 15, 1987 to S. J. Goedderz, Sr.;

CA Pat. No. 1,234,766, issued on Apr. 5, 1988 to E. B. Piercy et al.

The prior art also contains a cylindrical screen made of wire mesh and which completely encloses the upstream end of a culvert pipe. An example of this type of culvert pipe screen is described in:

CA Pat. No. 1,290,578, issued on Oct. 15, 1991 to N. J. Thurber.

Although several solutions have been proposed to the problems caused by beavers near culverts, it is believed that the prior art systems and devices are deficient in at least several important features. For example, some of the bars or rods of the screen are perpendicular to the flow of water and promote the accumulation of floating debris against the surface of the screen. A clogged screen on the end of a culvert pipe has a similar effect as a beaver dam, as the water accumulating at that location could also cause road flooding and road undermining. Also, a flat screen mounted over the end of a culvert pipe, or inside the pipe, does not prevent a beaver from anchoring a dam on the end of the culvert pipe. Therefore, flat screens are not considered to be an efficient solution to control beaver problems.

The deficiencies of flat screens have prompted other inventors to develop cone-shaped screens which extend away from the end of the culvert pipe and which are more efficient in preventing access to the end of the culvert pipe to a beaver. The cone-shaped screen normally makes an acute angle with the water currents and is therefore less susceptible to clogging. A cone-shaped screen also has a large surface as compared to the cross-section area of the culvert pipe on which it is mounted, and therefore more debris is required to clog it.

Therefore, the type of beaver control screen which is of interest herein has a conical shape and is secured to either end of a culvert pipe. Some examples of conical screens of the prior art are described in the following documents:

U.S. Pat. No. 2,970,697, issued on Feb. 7, 1961 to E. L. Larson et al.;

U.S. Pat. No. 3,472,030, issued on Oct. 14, 1969 to R. E. Rieke;

U.S. Pat. No. 5,102,537, issued on Apr. 7, 1992 to J. R. Jones;

CA Pat. No. 208,647, issued on Feb. 22, 1921 to L. H. Bradburn.

However, a conical screen has rods or bars which converge toward the apex thereof. When the cone-shaped screen is installed on the downstream end of a culvert pipe, these converging rods, with the force of water, act as a trap where fish can become caught. Therefore, the converging rods of cone-shaped screens are not recommended as they could eventually destroy the local fish population.

As such, it may be appreciated that there continues to be a need for a new and improved beaver control screen for installation on culvert pipes, which can be efficiently used to discourage the construction of beaver dams, which does not clog easily and which does not hinder the migration of local fish there through.

SUMMARY OF THE INVENTION

The beaver control screen according to the present invention has three main purposes. Firstly, the beaver control screen is made to protect the entire culvert against damages caused by debris transported by water, especially,during spring thaw periods and during heavy rainstorms. Secondly, the present invention is made to efficiently prevent beavers from building a dam on the end of a culvert pipe or inside a culvert pipe. Thirdly, the beaver control screen is made to preserve the natural fish habitat.

In accordance with a first aspect of the present invention, there is provided a beaver control screen comprising a cone-shaped screen having a base, an apex and a central horizontal axis and a length between the base and the apex. The cone-shaped screen has a first set of spaced-apart straight rods extending from the base to the apex and being disposed in a first conical layer. A second set of spaced-apart straight rods is disposed in a second conical layer inside the first conical layer and extends toward the apex over a distance of about one-half the length of the first conical layer. The second conical layer is disposed in a concentric relationship with the first conical layer. Each rod in the first conical layer is spaced away from an adjacent rod in the second conical layer a same spacing of about 3 inches along this adjacent rod. This spacing has been found to be advantageous for preventing access to the culvert pipe to adult and juvenile beavers, and on the other hand, has been found to be relatively tolerant to the passage of floating debris through the screen.

A beaver dam is usually built using intertwined branches and twigs of various sizes, cemented with mud, lichen and other aquatic plants. The smooth surface of the rods and the spacing between the rods at the base of the beaver control screen according to the present invention prevent the beavers from building a foundation of branches and twigs across the opening of the culvert pipe.

According to another feature of the present invention, the apex of the cone-shaped screen is made with an annular plate having an outside edge and an inside edge. The rods in the first conical layer are alternately affixed to the outside edge and to the inside edge. In this arrangement, a minimum spacing between any two adjacent rods in the screen can be made to be larger than other prior art arrangements where all the rods are affixed to each other or to the outside edge of the apex plate for examples. In areas where local fish species such as the char, (Salvelinus), co-habit with beavers, the minimum spacing between the rods is made to be at least about 1.25 inches, such that the converging rods of the screen do not constitute traps which could threaten the survival of fish population.

In accordance with yet another feature of the present invention, the beaver control screen is affixed to the culvert pipe by means of a hinge on the upper segment of culvert pipe. The hinge has a horizontal articulation axis. The beaver control screen according to the present invention is simply tilted upward about the hinge to clear any debris that might accumulate on its surface.

Other advantages and novel features of the present invention will become apparent from the following detailed description.

BRIEF DESCRIPTION OF THE DRAWINGS

One embodiment of this invention is illustrated in the accompanying drawings, in which like numerals denote like parts throughout the several views, and in which.

DESCRIPTION OF THE PREFERRED EMBODIMENT

Figure 1:
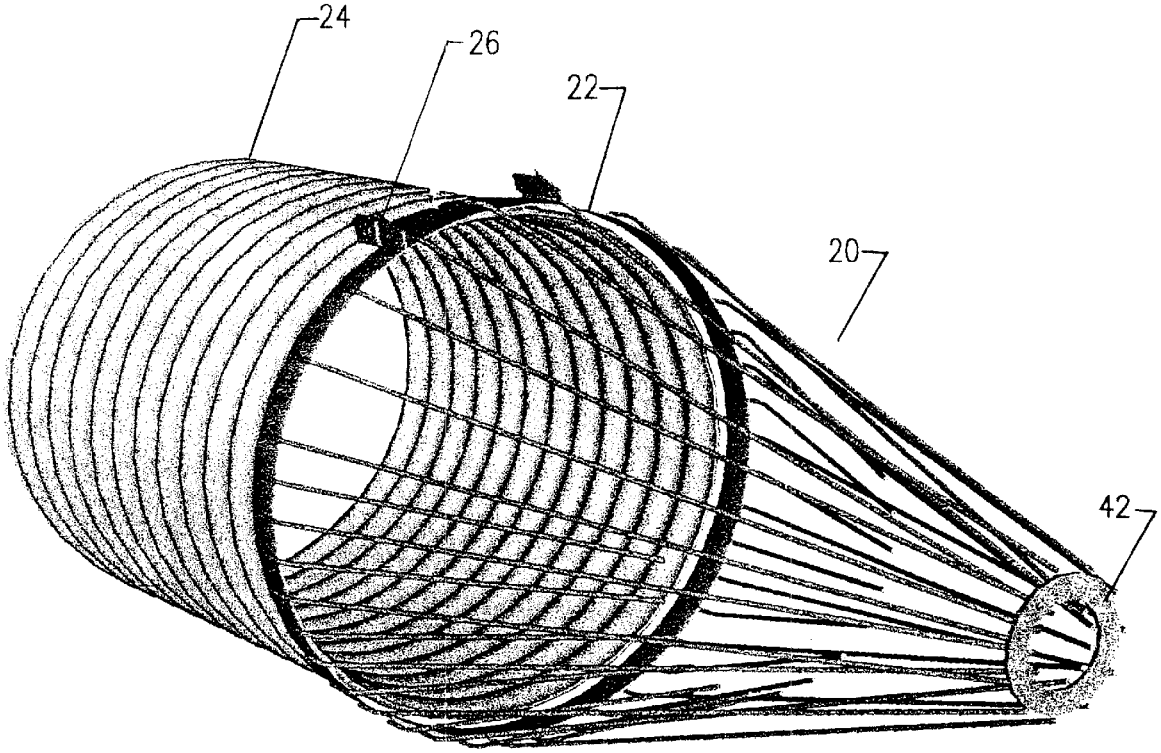
FIG. 1 is a perspective view of the beaver control screen according to the preferred embodiment of the present invention.

While this invention is susceptible of embodiment in many different forms, there is shown in the drawings and will be described in details herein one specific embodiment, with the understanding that the present disclosure is to be considered as an example of the principles of the invention and is not intended to limit the invention to the embodiment illustrated and described.

Figure 2:
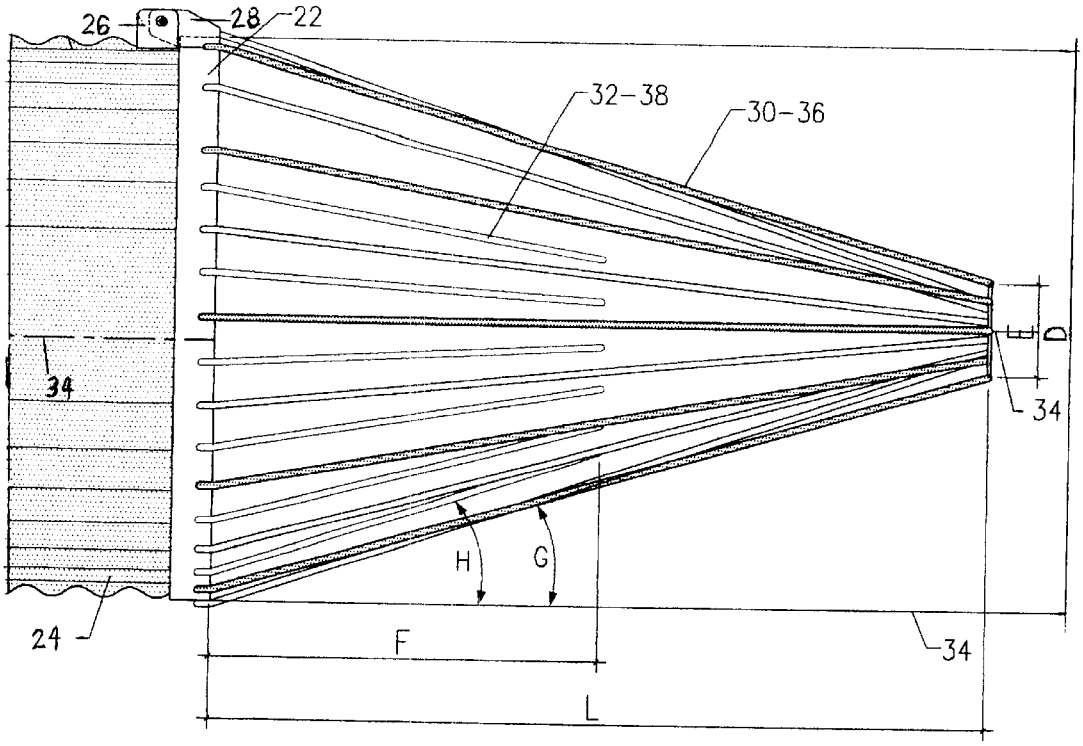
FIG. 2 is a side view of the beaver control screen.
Figure 3:
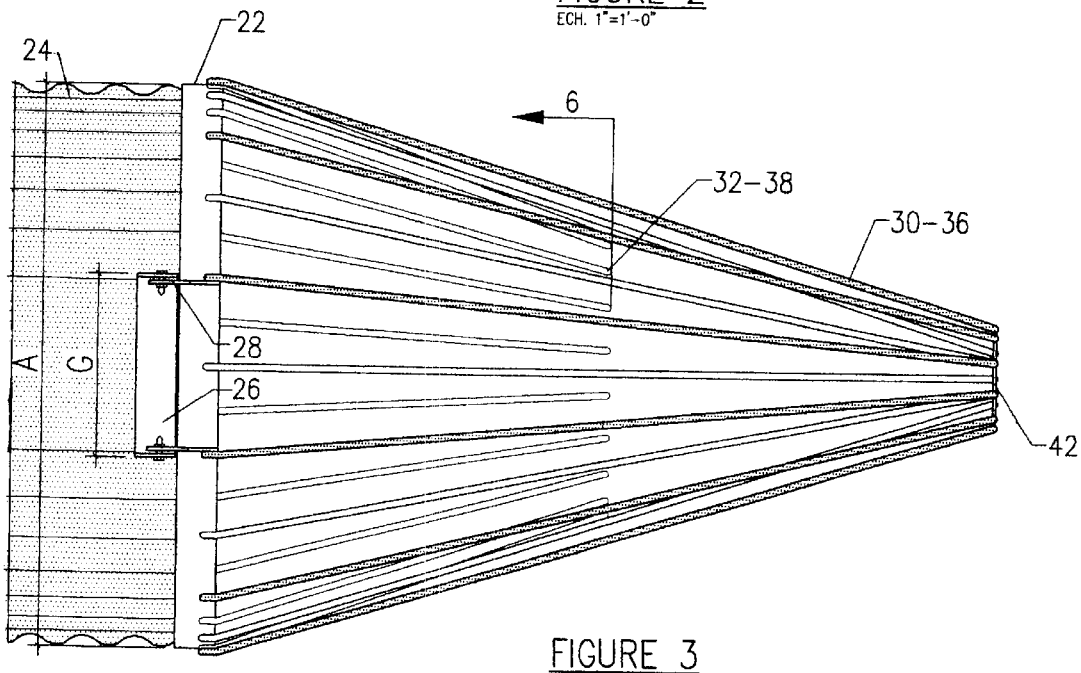
FIG. 3 is a top view of the beaver control screen mounted on the end of a culvert pipe.

Reference is firstly made to FIGS. 1–3. The beaver control screen 20 according to the preferred embodiment has a conical shape and a length 'L' which is longer than its diameter 'D', such that the surface thereof is much larger than the area defined by its diameter 'D'. When the beaver control screen 20 is partly obstructed, as with leaves and similar floating debris for examples, it still offers an opened surface which is substantially similar or larger than the cross-section area of the culvert pipe. In the beaver control screen 20 according to the preferred embodiment, the length 'L' of the conical portion is about 60 inches and the diameter 'D' is about 42 inches. The diameter 'E' of the small end of the conical portion is about 7 inches. The surface of the conical portion is about 5819 square inches and the cross-section area of the culvert pipe having a diameter of about 42 inches is about 1385 square inches. Therefore the beaver control screen 20 can be obstructed over half of its surface and still offer an opened area which is larger than the cross-section area of the culvert pipe.

A mounting ring 22 is made of flat bar material and defines the large end, or the base of the beaver control screen 20. The ring 22 encloses the end of the culvert pipe 24 on which the beaver control screen is mounted. A hinge 26 is affixed to the upper segment of the culvert pipe 24 by fasteners, welds or otherwise and supports the conical portion of the beaver control screen by means of gussets 28 affixed to the ring 22 and pivoted to the hinge 26.

The conical portion of the beaver control screen 20 consists of an outside conical layer 30, and an inside conical layer 32, mounted inside the outside conical layer, and extending from the ring 22 over a distance 'F' which is about one-half the length 'L' of the outside conical layer 30. On the preferred beaver control screen, the surface of the outside conical layer 30 makes an angle 'G' of about 18–20 degrees with the longitudinal central axis 34 of the beaver control screen 20. The surface of the inside conical layer 32 makes an angle 'H' of about 22–24 degrees with the longitudinal central axis 34. In FIG. 2, the longitudinal central axis 34 is shown inside and outside the beaver control screen 20, for convenience, as the angles described herein are geometrically identical with both positions of this axis.

Figure 4:
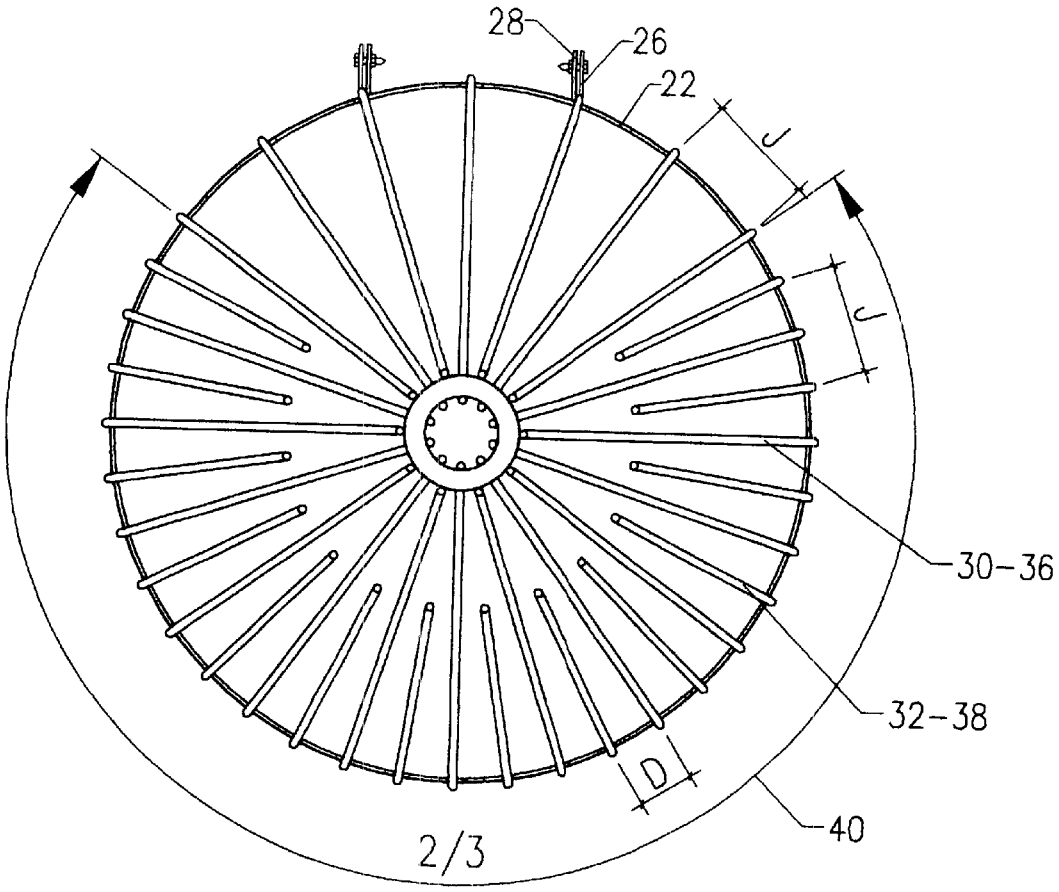
FIG. 4 is the end view of the beaver control screen.

In the preferred beaver control screen 20, the outside conical layer 30 is made of stiff and smooth rods 36, which are spaced apart a spacing 'J' of about 6–7 inches around the ring 22. The inside conical layer 32 is also made of stiff and smooth rods 38 which are spaced apart around the ring 22 the same distance 'J'. The rods 38 of the inside conical layer 32 are staggered between the rods 36 of the outside conical layer 30. The rods 38 of the inside conical layer 32 extends over a surface of about ⅔ of the circumference of the outside conical layer 30 as indicated by the arrow 40 in FIG. 4. This surface 40 is designated as the submerged segment of the beaver control screen 20. The purpose of this arrangement is to provide more opened area over the top portion, or emerged segment of the beaver control screen 20, to let a substantial quantity of floating debris, such as leaves, twigs and straw to pass through the screen. This also provide better space for fish passage. The submerged segment 40 of the screen 20 has smaller openings to prevent adult and juvenile beavers from swimming through the screen for the purpose of anchoring the foundation of a dam to the end of the culvert pipe.

Figure 5:
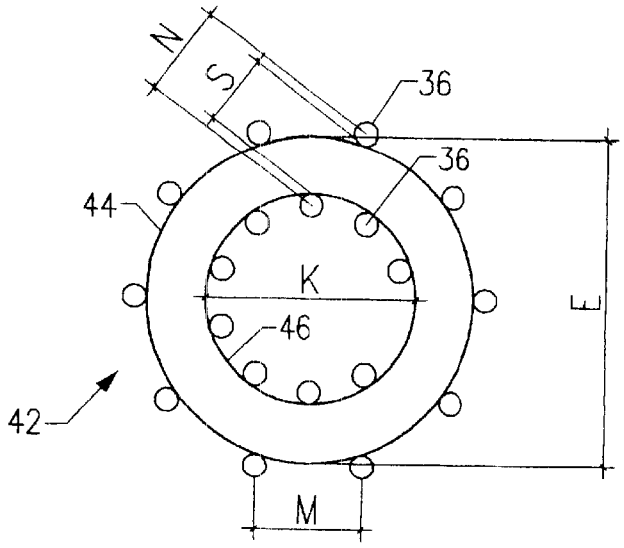
FIG. 5 illustrates an enlarged view of the annular plate at the apex of the beaver control screen.
Figure 6:
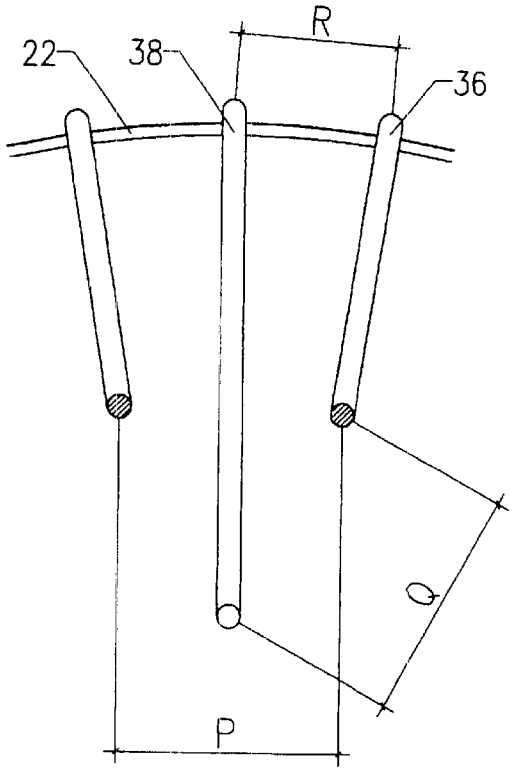
FIG. 6 is a cross-section view of the beaver control screen as seen along line 6 in FIG. 3.

Referring now to FIGS. 5 and 6, some important features of the beaver control screen 20 will be described. The apex of the outside conical layer 30 comprises an annular plate 42 which has an outside diameter 'E' of about 7 inches, and an inside diameter 'K' of about 4-½ inches, when applied to the dimension set of the beaver control screen 20 according to the preferred embodiment. In this preferred embodiment, there are between about twenty two to twenty four rods 36 in the outer conical layer 30. For the purpose of describing the following features, the number of rods 36 is taken as being twenty two. These rods 36 are alternately affixed to the annular plate 42 with one rod affixed to the outside edge 44 of the annular plate 42 and the next rod affixed to the inside edge 46 of the annular plate 42. This arrangement provides a rod spacing 'M' between the rods along the outside edge 44 of the annular plate 42 of about one inch, and a rod spacing 'N' between adjacent rods of about 1-¾ inches. It will be appreciated that the adjacent rod spacing on the outside conical layer 30 varies from 1-¾ inches at the apex 42 to about seven inches at the base ring 22.

For reference purpose the adjacent rod spacing 'P' at the dimension 'F' between the apex 42 and the base ring 22 of the screen is about four inches as illustrated in FIG. 6. The spacing 'Q' between a rod 36 from the outside conical layer 30 and an adjacent rod 38 from the inside conical layer 32 at the dimension 'F' is about 3-½ inches. From previously mentioned dimensions, it will be appreciated that the spacing 'R' between the same adjacent rods at the support ring 22 is also about 3-½ inches. Consequently, the spacing between a rod 36 in the outside conical layer 30 and an adjacent rod 38 in the inside conical layer 32 is about 3-½ inches along the entire length of the adjacent rod 38.

The rod diameter in the preferred beaver control screen 20 is about one-half inch. Therefore, the clearance between any two adjacent rods at the base of the beaver control screen 20 and over a distance of about one-half the total length of the beaver control screen 20 is about three inches. This clearance has been found to be ideal for preventing adult and juvenile beavers from circulating through the screen near the end of the culvert pipe 24 where a beaver dam needs to the anchored. This clearance is also advantageous for allowing common debris to float through the screen 20 without clogging the screen and to facilitate fish passage.

And of course, whenever some larger debris remain entangled to the surface of the beaver control screen 20 the provision of the hinge 26 makes it possible for someone standing on the end of the culvert pipe 24 to tilt the beaver control screen 20 upward to release the debris and to clean the screen.

Concerning the apex of the screen, it will also be appreciated that the clearance 'S' between any adjacent rods in the outside conical layer 30 is at least about 1.25 inch or more. This dimension has also been found to be advantageous for allowing local fish to easily swim through the beaver control screen 20, whether the screen is installed on the upstream or downstream end of the culvert pipe, without encountering any tight convergence where the fish can get caught. The beaver control screen 20 according to the present invention is therefore more acceptable to habitat conservation regulations than other cone-shaped screens of the prior art.

As to other dimensions, manner of usage and operation of the present invention, the same should be apparent from the above description and accompanying drawings, and accordingly further discussion relative to the manner of making, using and operating the invention would be considered repetitious and is not provided.

While one embodiment of the present invention has been illustrated and described herein above, it will be appreciated by those skilled in the art that various modifications, alternate constructions and equivalents may be employed without departing from the true spirit and scope of the invention. For example, the beaver control screen can be made of different materials, such as metal or plastic. It and can be made to mount on culvert pipes made of corrugated steel, concrete, plastic or other material, and having a circular or an oval shape. Therefore, the above description and the illustrations should not be construed as limiting the scope of the invention which is defined by the appended claims.

I claim:

1. A beaver control screen for installation on an end of a culvert pipe, comprising:

a cone-shaped screen having a base, an apex, and a central axis and a length between said base and said apex;

said cone-shaped screen comprising a first set of spaced-apart straight rods extending from said base to said apex and being disposed in a first conical layer, and a second set of spaced-apart straight rods extending over a distance from said base toward said apex and being disposed in a second conical layer inside said first conical layer, in a concentric relationship with said first conical layer, and each rod in said first set of spaced-apart straight rods being spaced away from an adjacent rod in said second set of spaced-apart straight rods a same spacing along said adjacent rod.

2. The beaver control screen as claimed in claim 1, wherein said same spacing is about 3 inches.

3. The beaver control screen as claimed in claim 1, further comprising a ring along said base and a hinge affixed to said ring and having means for attachment to a culvert pipe.

4. The beaver control screen as claimed in claim 1, wherein said first conical layer makes an angle of about 18–20 degrees with said central axis.

5. The beaver control screen as claimed in claim 4, wherein said second conical layer makes an angle of about 22–24 degrees with said central axis.

6. The beaver control screen as claimed in claim 1, wherein said distance is about one-half said length.

7. The beaver control screen as claimed in claim 1, wherein said second conical layer extends over about ⅔ a circumference of said first conical layer.

8. The beaver control screen as claimed in claim 1, wherein said apex comprises an annular plate having an outside edge and an inside edge, and wherein said rods in said first set of spaced-apart straight rods are alternately affixed to said outside edge and to said inside edge.

9. The beaver control screen as claimed in claim 8, wherein a minimum clearance between adjacent rods in said first set of spaced-apart straight rods is about 1.25 inches.

10. A beaver control screen for installation on an end of a culvert pipe, comprising:

a cone-shaped screen having a base, an apex, a central axis and a length between said base and said apex;

said cone-shaped screen comprising a first set of spaced-apart straight rods extending from said base to said apex, and said apex comprising an annular plate having an outside edge and an inside edge, and said rods in said first set of spaced-apart straight rods being alternately affixed to said outside edge and to said inside edge.

11. The beaver control screen as claimed in claim 10, wherein a minimum clearance between adjacent rods in said first set of spaced-apart straight rods is about 1.25 inches.

12. The beaver control screen as claimed in claim 10, wherein said first set of spaced-apart straight rods is disposed in a conical layer making an angle of about 18–20 degrees with said central axis.

13. The beaver control screen as claimed in claim 12, further comprising a second set of spaced-apart straight rods extending from said base toward said apex and defining a second conical layer inside, and concentric with, said first conical layer.

14. The beaver control screen as claimed in claim 13, wherein said second conical layer makes an angle of about 22–24 degrees with said central axis.

15. The beaver control screen as claimed in claim 14 wherein said second set of spaced-apart straight rods extends from said base to about one-half said length.

16. In combination, a culvert pipe and a beaver control screen mounted on an end of said culvert pipe, said beaver control screen comprising:

a cone shaped screen having a base, an apex, an axis and a length between said base and said apex;

said cone shaped screen comprising a first set of spaced-apart straight rods extending from said base to said apex and being disposed in a first conical layer and a second set of equally-spaced straight rods extending from said base over a distance toward said apex and being disposed in a second conical layer inside and concentric with said first conical layer;

each rod in said first set of spaced-apart straight rods is spaced away from an adjacent rod in said second set of spaced-apart straight rods a same spacing along said adjacent rod, and said apex comprising an annular plate having an outside edge and an inside edge, and said rods in said first set of spaced-apart straight rods being alternately affixed to said outside edge and to said inside edge.

17. The combination as claimed in claim 16, further comprising a hinge affixed to said base and to said culvert pipe.

18. The combination as claimed in claim 17, wherein said cone-shaped screen comprises a submerged segment and an emerged segment and said hinge is affixed to said emerged segment.

19. The combination as claimed in claim 16, wherein a minimum clearance between adjacent rods in said first set of spaced-apart straight rods, near said annular plate is about 1.25 inches.

20. The combination as claimed in claim 19, wherein said same spacing is about 3 inches.

* * * * *